US006205300B1

(12) United States Patent
Sakai

(10) Patent No.: US 6,205,300 B1
(45) Date of Patent: Mar. 20, 2001

(54) IMAGE FORMING APPARATUS FOR FORMING A MORE UNIFORM IMAGE

(75) Inventor: Chinobu Sakai, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/128,551

(22) Filed: Aug. 4, 1998

(30) Foreign Application Priority Data

Aug. 4, 1997 (JP) ..... 9-209235

(51) Int. Cl.[7] ..... G03G 15/00; G03G 15/16
(52) U.S. Cl. ..... 399/66; 399/315; 399/398
(58) Field of Search ..... 399/66, 315, 388, 399/398

(56) References Cited

U.S. PATENT DOCUMENTS

| | | | | |
|---|---|---|---|---|
| 4,408,863 | * | 10/1983 | Ogata et al. | 399/66 |
| 4,412,732 | * | 11/1983 | Ogata et al. | 399/66 |
| 4,491,407 | | 1/1985 | Mitsuyama et al. | 355/3 |
| 5,125,644 | * | 6/1992 | Masaki et al. | 399/398 X |
| 5,541,718 | * | 7/1996 | Oono | 399/398 X |

FOREIGN PATENT DOCUMENTS

| | | |
|---|---|---|
| 32 20 294 | 12/1982 | (DE) . |
| 59-182482 | 10/1984 | (JP) . |
| 61-32667 | 7/1986 | (JP) . |
| 1-93776 | 4/1989 | (JP) . |
| 5-313518 | 11/1993 | (JP) . |
| 9-44000 | 2/1997 | (JP) . |

* cited by examiner

*Primary Examiner*—Fred L Braun
(74) *Attorney, Agent, or Firm*—Foley & Lardner

(57) ABSTRACT

An image forming apparatus including an image forming unit to form a developer image on an image carrier, a conveying member to convey an image receiving member toward the image carrier, a transfer charger to transfer the developer image formed on the image carrier on the image receiving member by giving a transfer charge to the image receiving member conveyed by the conveying member, a guide member provided between the conveying member and the transfer charger to guide the image receiving member conveyed by the conveying member toward the transfer position and a separation charger arranged at the downstream side of the transfer charger along the transfer direction of the image receiving member to separate the image receiving member with the developer image transferred thereon by the transfer charger. A bias voltage having the same polarity as the transfer charge is applied to the guide member. When the developer image is transferred on the image receiving member by the transfer charger, this bias voltage is controlled so that it is set at a first bias voltage before the image receiving member comes near the separation charger and at a second bias voltage that is larger than the first bias voltage when the image receiving member comes near the separation charger.

13 Claims, 7 Drawing Sheets

| ITEM | MARK | TIME | DISTANCE |
|---|---|---|---|
| BETWEEN ALIGNING ROLLER AND TRANSFER | A | 398 msec | 51 mm |
| BETWEEN TRANSFER AND SEPARATION | F | 107 msec | 13.6 mm |
| TRANSFER ON MARGIN | B | 78 msec | 10 mm |
| TRANSFER GUIDE BIAS ON DELAY | C | 107 msec | 13.6 mm |
| TRANSFER GUIDE BIAS OFF MARGIN | E | 78 msec | 10 mm |

PROCESS SPEED: 127 mm/sec

LENGTH OF PAPER: D mm

TRANSFER GUIDE BIAS HIGH = 600 V

TRANSFER GUIDE BIAS LOW = 100 V

| ITEM | MARK | TIME | DISTANCE |
|---|---|---|---|
| BETWEEN ALIGNING ROLLER AND TRANSFER | A | 398 msec | 51 mm |
| BETWEEN TRANSFER AND SEPARATION | F | 107 msec | 13.6 mm |
| TRANSFER ON MARGIN | B | 78 msec | 10 mm |
| TRANSFER GUIDE BIAS ON DELAY | C | 107 msec | 13.6 mm |
| TRANSFER GUIDE BIAS OFF MARGIN | E | 78 msec | 10 mm |

PROCESS SPEED: 127 mm/sec

TRANSFER GUIDE BIAS = 600 V

LENGTH OF PAPER: D mm

IMAGE FORMING APPARATUS FOR FORMING A MORE UNIFORM IMAGE

BACKGROUND OF THE INVENTION

1. Field of the Invention

The present invention relates to an image forming apparatus that forms an image on a paper by visualizing an electrostatic latent image formed on a photosensitive drum by supplying a developer and by transferring this visualized developer image on the paper.

2. Description of the Related Art

As disclosed in Japanese Patent Publication (Kokoku) No. 61-32667, in a conventional copying machine, at the same time when transfer current is given to the transfer charger, the voltage of the same polarity as the voltage applied to the transfer charger is applied to a transfer guide which leads a paper to the transfer position, thus, the undesired outflow of the charge given by the transfer charger is prevented.

By the way, the transfer current that is given to the transfer charger is given immediately before the leading edge of the paper comes near the transfer position in order to obtain good transfer efficiency. It was found that pits are produced by the excessive transfer in an area near the leading edge of the paper if the transfer guide bias was applied at the same timing as this transfer current.

That is, in the state before the leading edge of the paper being conveyed along the transfer guide, of which electric resistance is dropped, comes near the separation charger positioned at the downstream side of the transfer charger, the electric charge given by the transfer charger is considered to flow out via the transfer guide only. Further, it is also considered that the electric charge given by the transfer charger flows to the transfer guide and also to the separation charger when the leading edge of the paper comes near the separation charger and the outflow amount of the charge increases. Accordingly, if this transfer guide bias is set at a size to give a proper potential at the central part occupying the greater part of the paper, the potential near the leading edge of the transfer paper before it comes near the separation charger becomes large unnecessarily and such transfer faults as pits due to excessive transfer are produced.

As a countermeasure to prevent such transfer faults, the control is considered to change a transfer current value that is given to the transfer charger before and after the leading edge of the paper comes near the separation charger but there is caused a new problem that such transfer faults as pits due to insufficient transfer are produced near the leading edge of the paper if a normal paper of which electric resistance is not dropped is supplied.

SUMMARY OF THE INVENTION

The present invention has been made in view of the above and it is an object to provide an image forming apparatus capable of achieving good transfer efficiency for the overall length of a paper and forming an image of good quality.

According to the present invention an image forming apparatus is provided. The image forming apparatus comprises image forming means for forming a developer image on an image carrier; conveying means for conveying a paper toward the image carrier; transfer means for giving a transfer charge to the paper conveyed by the conveying means and transferring the developer image formed on the image carrier to the paper; a guide member for guiding the paper conveyed by the conveying means toward the transfer means; separation means, arranged at the downstream side of the transfer means along the transfer direction of the paper, for separating the paper having the developer image transferred by the transfer means from the image carrier; applying means for applying a bias voltage of the same polarity as the transfer charge; and control means for setting the bias voltage by the applying means at a first bias voltage before the paper comes to near the separation means when transferring the developer image onto the paper by the transfer means and setting the bias voltage at a second bias voltage that is larger than the first bias voltage at the time when a paper comes to near the separation means.

DETAILED DESCRIPTION OF THE PREFERRED EMBODIMENTS

Figure 1:
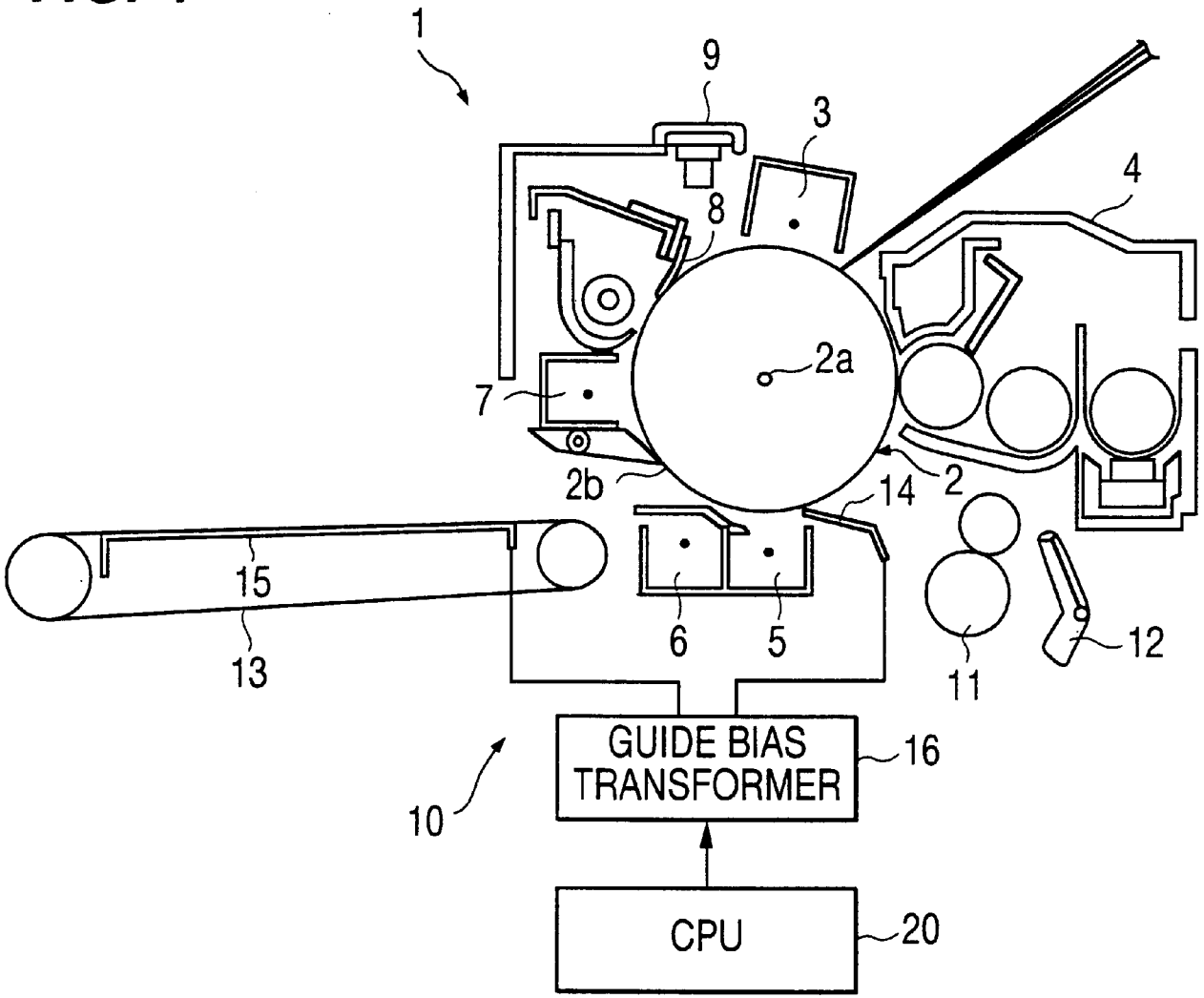
FIG. 1 is a schematic diagram showing the essential parts of a copying machine as an image forming apparatus of the present invention.

Hereinafter, the preferred embodiments of the present invention will be described with reference to the attached drawings. FIG. 1 is a diagram schematically showing the essential parts of an electro-photographic copying machine 1 as an image forming apparatus of the present invention.

The copying machine 1 has a photosensitive drum 2 that is an image carrier composed of basically a conductive supporter, an optical conductive layer and an insulating layer approximately at its center. The photosensitive drum has rotary shaft 2*a* at its center and the photosensitive drum 2 is rotated by the rotation of the rotary shaft 2*a*. Around the photosensitive drum 2, in order, the are a main charger 3, which uniformly charges the surface 2*b* of the photosensitive drum 2 (hereinafter simply referred to as the drum surface 2*b*) by giving the electric charge thereto, an exposure device (not shown), a developing device 4, a transfer charger 5, a separation charger 6, a pre-cleaning charger 7, a cleaning blade 8 and a charge eliminating lamp 9.

The main charger 3 uniformly charges the drum surface 2*a* by giving the electric charge thereto.

The exposure device exposes the drum surface 2*b* according to an image signal and forms an electrostatic latent image thereon.

The developing device 4 supplies two component developer comprising charged toner particles and carrier particles and visualizes (develops) the electrostatic latent image as a toner image.

The transfer charger 5 is arranged at the transfer position nearly just below the photosensitive drum 2 opposing to the drum surface 2*b*, and giving the electric charge (positive charge) by the corona discharge to the back of a paper that is an image receiving member passing the transfer position, visualizes the toner image formed on the drum surface 2*b* by the electric charge.

The separation charger 6 separates the paper with the toner image transferred from the drum surface 2*b* by giving the electric charge of the polarity reverse to the transfer charge (negative charge) through the corona discharge.

The pre-cleaning charger 7 neutralizes the positive charge that was applied to the photosensitive drum 2 in the inverse development by the transfer charger 5 but was not neutralized by the negative charge received from the separation charger 6 and left on the drum surface 2*b*.

The cleaning blade 8 scrapes off the toner left on the drum surface 2*b*.

The charge eliminating lamp 9 applies the charge eliminating light to the drum surface 2*b* and removes the electric charge left on the drum surface 2*b*.

In front of and behind the transfer charger 5 and the separation charger 6, there is provided a conveyor device 10 to convey a paper at the same speed as the peripheral speed of the photosensitive drum 2 through a transfer point T (will be described later) between the transfer charger 5 and a separation point S (will be described later) between the separation charger 6.

The conveyor device 10 has an aligning roller pair 11 provided on the conveying path at the upper stream side of the transfer charger 5, a paper edge sensor 12 provided immediately before the aligning roller pair 11, a conveyor belt 13 provided on the conveying path at the downstream side of the separation charger 6, a transferring guide 14 provided immediately before the transfer position to guide the paper to the transfer position, a conductive guide plate 15 provided along the conveying surface of the conveyor belt 13 and a guide bias transformer 16 to apply a specified transfer guide bias (hereinafter referred to simply as the guide bias) to the transferring guide 14 and the guide plate 15. Further, the guide bias transfer 16 is connected with a CPU 20 that acts as a controller of the present invention.

The photosensitive drum 2 is rotated at the specified peripheral speed, the drum surface 2*b* is charged to a specified potential by the main charger 3, the charged drum surface 2*b* is exposed by an exposure device (not shown) and an electrostatic latent image is formed on the drum surface 2*b*. A developer is supplied to the electrostatic latent image via the developing device 4, the electrostatic latent image is developed and a toner image is formed on the drum surface 2*b*.

The toner image thus developed on the drum surface 2*b* is conveyed to the transfer position by the rotation of the photosensitive drum 2 and transferred on the paper by the transfer charger 5. At this time, the paper passes the paper edge sensor 12, once aligned by the aligning roller 11 and then is fed to the transfer position at a timing conforming to the toner image on the rotating drum surface 2*b*. Further, the paper fed from the aligning roller is conveyed to the transfer position along the transferring guide 14.

The paper with the toner image thus transferred is separated from the drum surface 2*b* by the separation charger 6 and conveyed to a fixing position (not shown) via the conveyor belt 13 arranged at the downstream side of the transfer position.

On the other hand, the residual charge on the drum surface 2 that passed the transfer position is neutralized by the pre-cleaning charger 7. Further, the residual toner left on the drum surface 2*b* is scraped off by the cleaning blade 8. Furthermore, preparing for the subsequent image forming process, the charge eliminating light is applied to the drum surface 2*b* by the charge eliminating lamp 9 to eliminate the residual charge on the drum surface 2*b*.

As described above, when the paper having sufficient electric resistance is supplied, a toner image is transferred satisfactorily on the paper and an image of good quality can be formed. However, when the paper having lowered electric resistance as, for instance, left for a long time in the high temperature and humid environment, such controls as described below become necessary.

Figure 2:
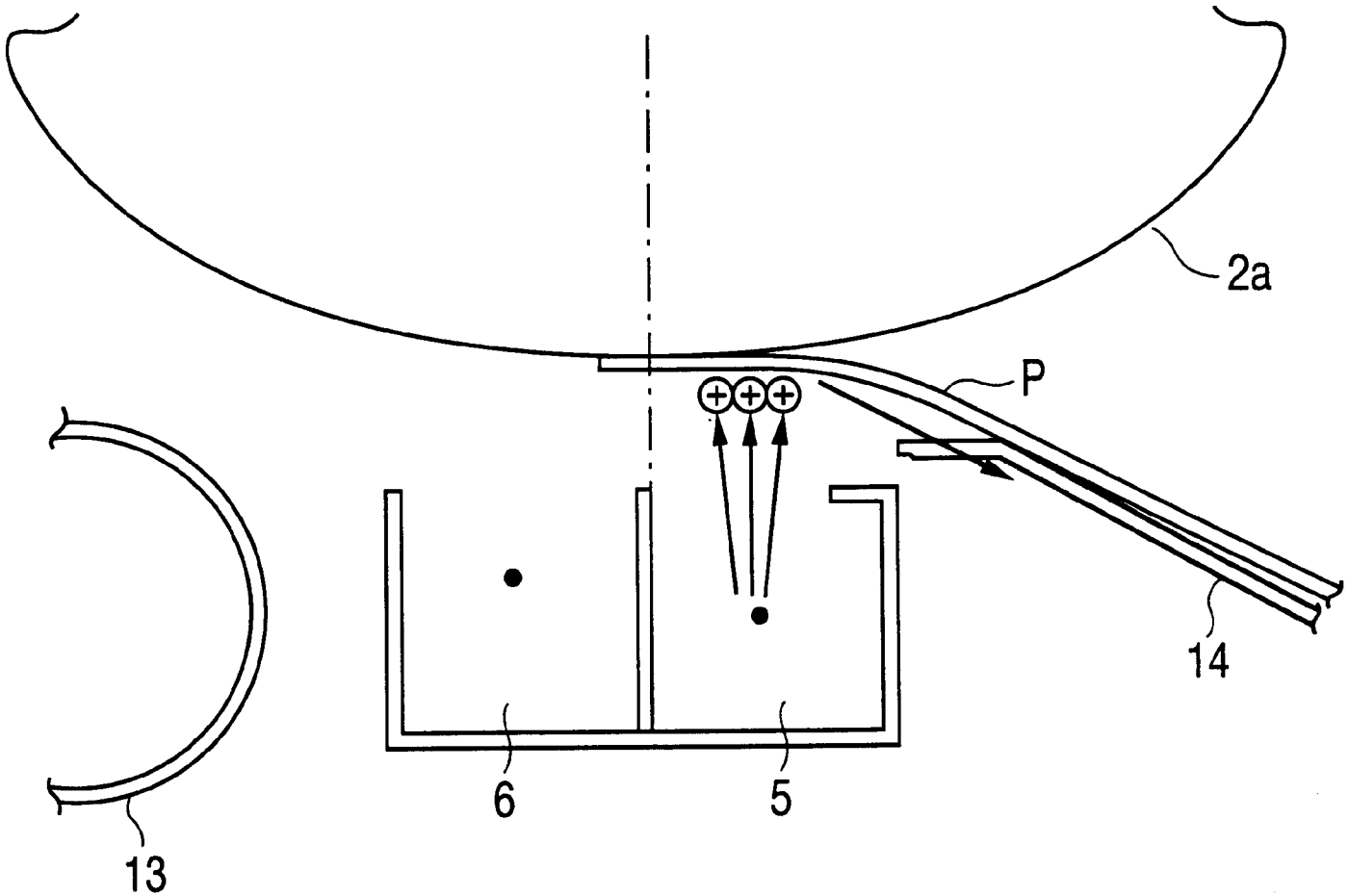
FIG. 2 is a diagram showing the state of a paper conveyed to the transfer position shown in FIG. 1.
Figure 3:
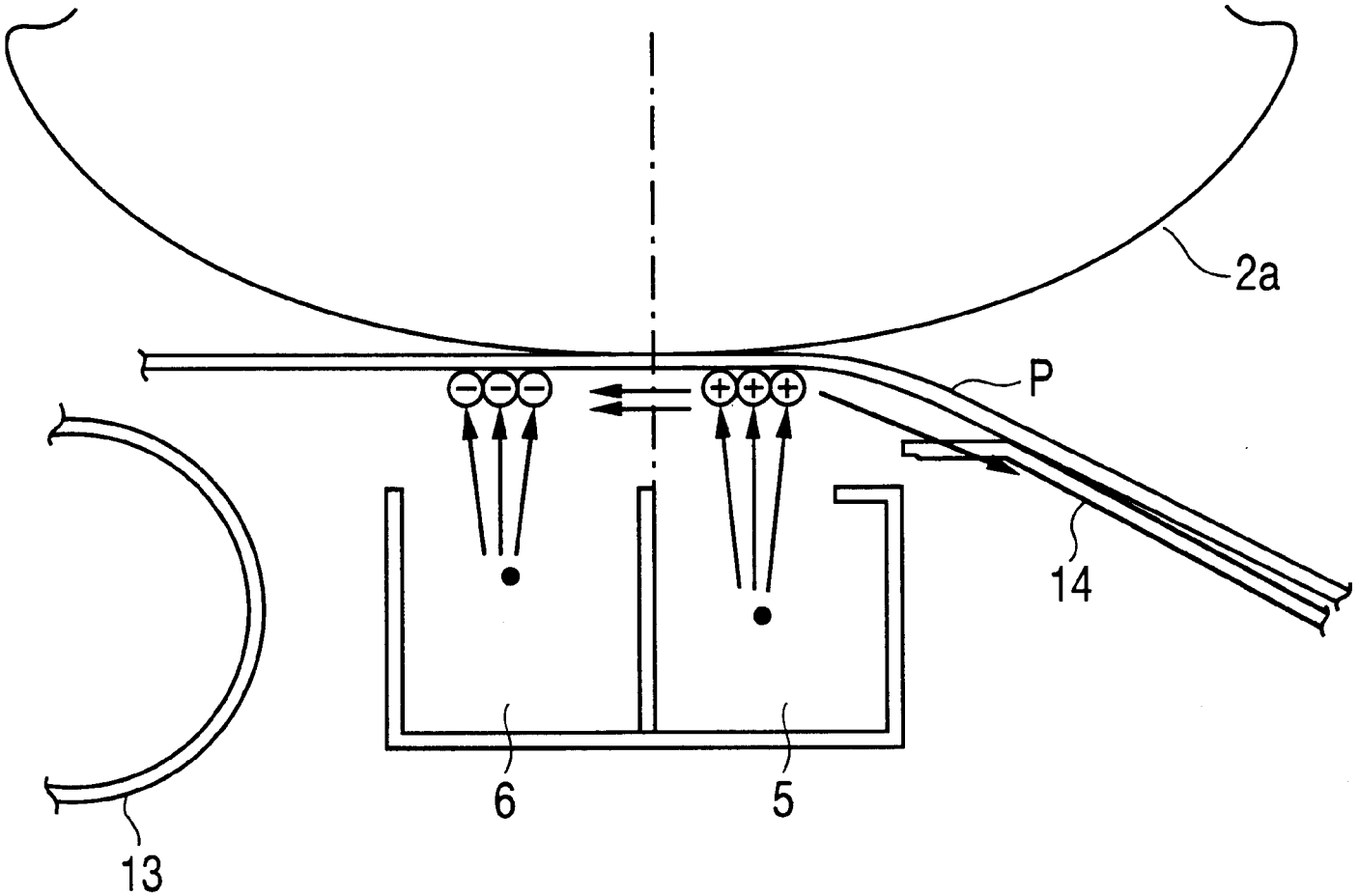
FIG. 3 is a diagram showing the state of a paper passing through the transfer position shown in FIG. 1.

That is, a paper P fed from the aligning roller 11 is conveyed to the transfer position along the transferring guide 14 as shown in FIG. 2. At this time if the paper P having dropped electric resistance as described above is supplied, a part of the positive charge given by the transfer charger 5 flows into the transferring guide 14 via the paper P and the electric charge required for the transfer becomes short. Further, as shown in FIG. 3, after the leading edge of a paper P comes near the separation charger 6, the positive charge from the transfer charger 5 flows into the transferring guide 14 and at the same time, a part of the positive charge given by the transfer charger 5 is negated by the negative charge given by the separation charger 6 and the electric charge required for the transfer becomes further short.

So, it is so devised as to apply the guide bias in a specified size to the transferring guide 14 and the guide plate 15 via the guide bias transformer 16 to suppress the outflow of the charge required for the transfer.

However, because the outflow amount of the transfer charge is different before and after when the leading edge of the paper P comes near to the separation charge 6 (before separated; small, after separated; large) as described above, a proper guide bias value for suppressing the outflow of the electric charge, that is, a proper guide bias value of the electric charge required for the image transfer that can be given to a paper is also different before and after the separation of the paper.

Figure 4:
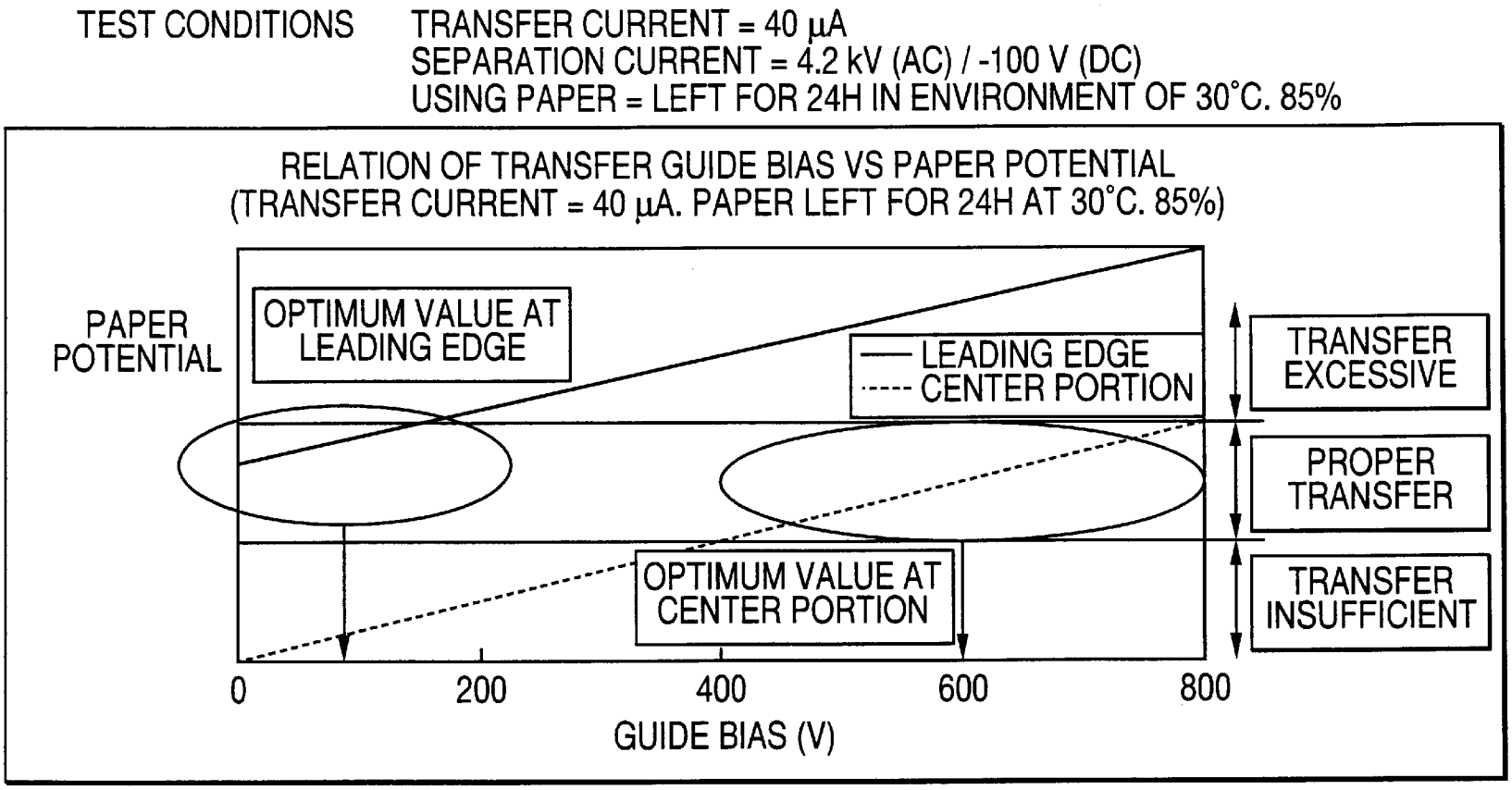
FIG. 4 is a graph showing the relation between the guide bias and the paper potential at the leading edge and the central part of a paper.

FIG. 4 shows the relation of a paper potential vs. a guide bias at the leading edge (before separated) and the center (after separated) of the paper that was left for 24 hours in the environment, for instance, at temperature 30° C. and humidity 85% when it was supplied. Further, at this time, the transfer current was set at a constant current of 40 $\mu$A and the separation current applied to the separation charger was set at 4.2 kV (AC) to −100 V (DC).

According to the test result shown in FIG. 4, the optimum guide bias value in the image transfer to the leading edge of the paper P before it comes near the separation charger 6 was 0–200 V and the optimum bias value in the image transfer to the center of the paper P after the edge of the paper P arrived at the separation charger 6 was 400–800 V. In other words, when the guide bias transformer 16 is controlled by the CPU 2 so as to apply the guide bias of 0–200 V when the edge of the paper P was at the transfer charger 5 and to apply the guide bias of 400–800 V when the leading edge of the paper P comes near the separation charger 6 and the center of the paper P is at the transfer charger 5, the paper potential of the paper P can be controlled to a proper value required for the image transfer.

Hereinafter, the switching control of the guide bias to obtain a proper paper potential at the leading edge and the center of the paper P when it is supplied under the conditions shown in FIG. 4 will be described.

Figures 5, 6:
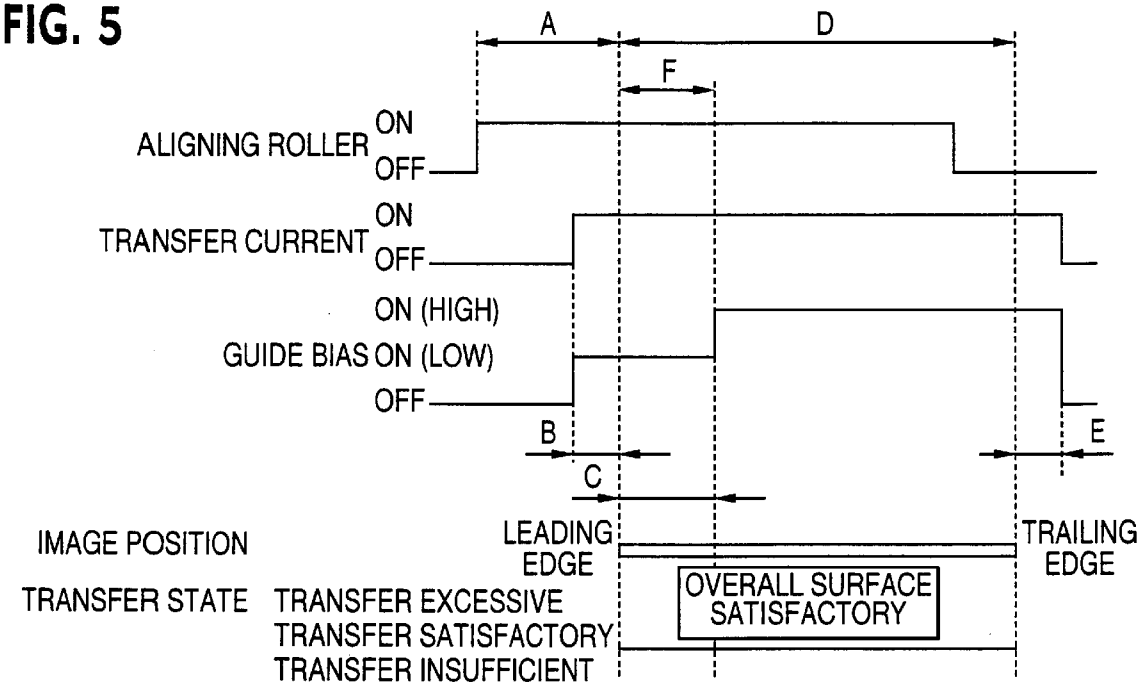
FIG. 5 is a timing chart showing the aligning roller driving timing, transfer current application timing, guide bias application timing and the transfer state at each timing in the first embodiment of the image forming apparatus of the present invention.
FIG. 6 is a diagram showing definite times and conveying distances at the timing shown in FIG. 5.

FIG. 5 is a timing chart showing the ON/OFF timing of the aligning roller 11, the transfer current application timing, the transferring guide bias control timing and the transfer state at respective timings in a first embodiment of the present invention.

In FIG. 6, A–F times (msec) and conveying distances (mm) shown in the timing chart of FIG. 5 are shown definitely.

Figure 7:
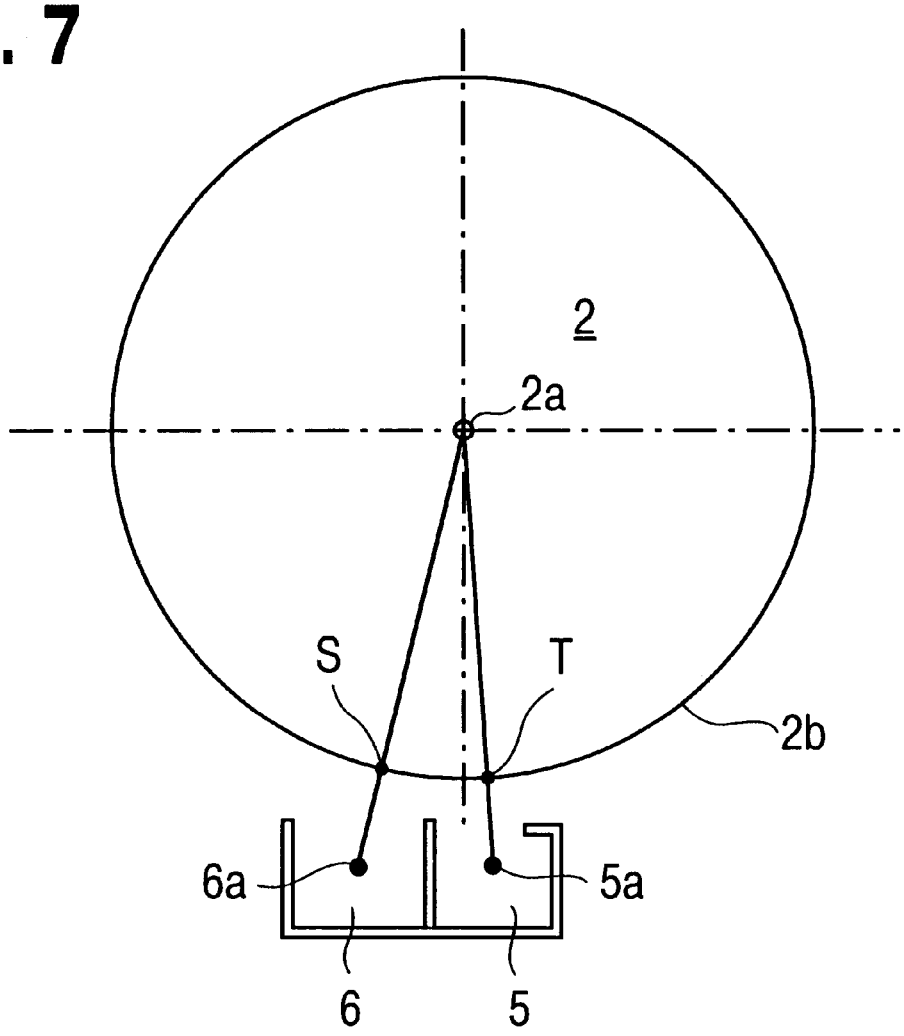
FIG. 7 is a diagram for explaining a transfer point and a separation point.

Further, in FIG. 7, the transfer point T and the separation point S are illustrated. Further, the transfer point T referred to here denotes a crossing point (a straight line) of a straight line (a plane) connecting the rotary shaft 2*a* of the photosensitive drum 2 and the charge wire 5*a* of the transfer charger 5 with the drum surface 2*b*. The separation point S denotes a crossing point of a straight line connecting the rotary shaft 2*a* of the photosensitive drum 2 and the charge wire 6*a* of the separation charger 6 with the drum surface 2*b*.

When the aligning roller 11 is rotated and the conveyance of the paper P starts, the specified transfer current is given to the charge wire 5*a* of the transfer charger 5 at the timing faster than a time until the leading edge of the paper P reaches the transfer point or a conveying distance (hereinafter, explained as a time) A by B. At the same time, a first guide bias (Low) of 100 V is applied to the transfer guide 14 and the guide plate 15. That is, as the proper guide bias value to the leading edge of the paper P is 0–200 V as described above, until the leading edge of the paper P comes near the separation charge 6, that is, the guide bias has a Low output until immediately before the leading edge of the paper P passes the transfer point T and reaches the separation point S.

Then, at the point of time F or C when the leading edge of the paper P is conveyed from the transfer point T to the separation point S, the guide bias is switched to the High output of the second guide bias 600 V. That is, as the proper guide bias value to the central part of the paper P 400–800 V as described above, the guide bias is has a High output when the leading edge of the paper P reaches the separation point S.

Further, the overall length of the paper P is shown by D and after the trailing edge passes the transfer point T, the transfer current and the guide bias are turned off later by a margin E.

It is possible to obtain the good transfer efficiency for the overall length of the paper P and output an image of excellent quality.

Further, when the paper P having a normal electric resistance value that was not dropped is supplied, the electric charge flowing by way of the paper P is extremely less even when the guide bias is controlled as described above and therefore, the transfer charge is scarcely affected by the guide bias. In other words, even when the guide bias is switched conforming to the paper P having reduced electric resistance as shown in the first embodiment, it is possible to get the good transfer efficiency for all paper regardless of the state of paper.

Further, in the first embodiment described above, it is considered that an error may be caused in the convey timing of the paper P for the delay in operation of a clutch to turn the aligning roller 11 ON/OFF. However, the timings are set by correcting such errors in the paper conveyance. Further, in a second embodiment, it is important to switch the guide bias when the leading edge of the paper P reaches the separation point S an if this timing is shifted, the good transfer efficiency cannot be obtained.

Figures 8, 9:
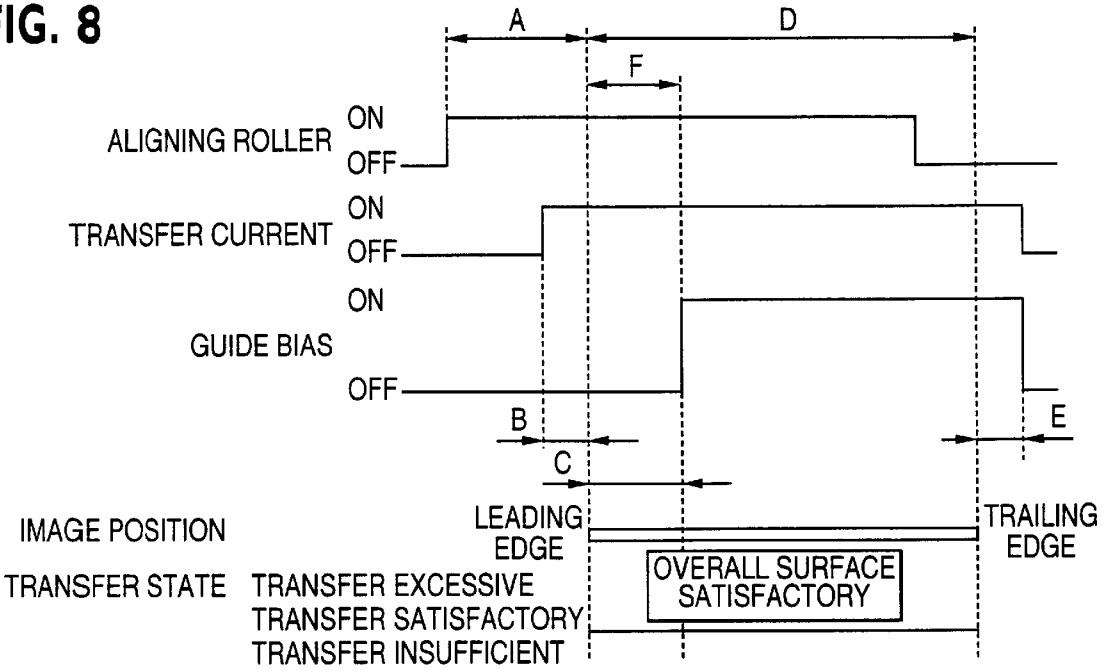
FIG. 8 is a timing chart showing the aligning roller driving timing, transfer current application timing, guide bias application timing and the transfer state of each timing in the second embodiment of the image forming apparatus of the present invention.
FIG. 9 is definite times and conveying distances at the timings shown in FIG. 8.

Next, the second embodiment of the present invention will be described. FIG. 8 shows the timings of the aligning roller, transfer current and guide bias and FIG. 9 shows definite numerical values.

In the second embodiment, when the transfer current is turned ON, the guide bias is not applied simultaneously but the guide bias of 600 V is applied to the transferring guide 14 and the guide plate 15 when the leading edge of a paper P reaches the separation point S.

In other words, the Low output in the first embodiment is 0 V.

As the optimum value of the guide bias at the leading edge of paper P includes 0 V as shown in FIG. 4, the good transfer efficiency can be obtained likewise even when the guide bias at the leading edge of the paper P is set at 0 V. Further, as it is not necessary to switch the guide bias between the Low output and the High output, the structure of the guide bias transformer can be made more simple than the first embodiment and the equipment cost can be reduced.

Further, the present invention is not limited to the above-mentioned first and second embodiments but various changes and modifications may be made within its scope.

As described in the above, an image forming apparatus of the present invention has the structure and actions as described above and is able to obtain the good transfer efficiency for the overall length of the paper and an image of good quality can be formed.

What is claimed is:

1. An image forming apparatus comprising:

image forming means for forming a developer image on an image carrier;

conveying means for conveying an image receiving member toward the image carrier;

transfer means for supplying a transfer charge to the image receiving member conveyed by the conveying means and transferring the developer image formed on the image carrier to the image receiving member;

a guide member, provided between the conveying means and the transfer means, for guiding the image receiving member conveyed by the conveying means toward the transfer means;

separation means, arranged at the downstream side of the transfer means along the transfer direction of the image receiving member, for supplying a separation charge to the image receiving member to separate the image receiving member having the developer image transferred by the transfer means from the image carrier;

applying means for applying a bias voltage of the same polarity as the transfer charge to the guide member; and control means for controlling the applying means to apply a first bias voltage to the guide member when a part of the image receiving member receives only the transfer charge from the transfer means and a remaining part of the image receiving member is put on the guide member, and for controlling the applying means to apply a second bias voltage larger than the first bias voltage when a part of the image receiving member receives both of the transfer charge and the separation charge from both of the transfer means and separation means and a remaining part of the image receiving member is put on the guide member.

2. The image forming apparatus according to claim 1, wherein the image forming means includes:

charging means for charging the surface of the image carrier to a specified potential by giving an electric charge thereto;

exposure means for exposing the surface of the image carrier charged by the charging means according to an image signal to form an electrostatic latent image; and developing means for forming the developer image by supplying a charged developer to the electrostatic latent image formed on the surface of the image carrier.

3. The image forming apparatus according to claim 1, wherein the guide member is made of a conductive member.

4. The image forming apparatus according to claim 1, wherein the image carrier includes a photosensitive drum arranged rotatable centering around a rotary shaft;

the transfer means includes a transfer charger arranged opposing to the surface of the photosensitive drum and having a first charge wire extending nearly in parallel with the rotary shaft of the photosensitive drum to transfer the developer image from the photosensitive drum onto the image receiving member by giving the corona discharge from the first charge wire to the image receiving member;

the separation means includes a separation charger having a second charge wire extending nearly in parallel with the rotary shaft of the photosensitive drum to separate the image receiving member from the drum surface by giving the corona discharge from the second charge wire; and the control means sets the bias voltage at the first bias voltage until the leading edge of the image receiving member reaches a separation point where the straight line connecting the second charge wire of the separation charger and the rotary shaft crosses the drum surface after the leading edge of the image receiving member in the conveying direction reaches a transfer point where the straight line connecting the first charge wire of the transfer charger and the rotary shaft of the photosensitive drum, and sets the bias voltage at the second bias voltage when the image receiving member is passing the transfer point and its leading edge in the conveying direction reaches the separation point.

5. The image forming apparatus according to claim 1 further comprising:

second conveying means for conveying the image receiving member passed the separation means further to the downstream; and the applying means also applies the same bias voltage as the bias voltage applied to the guide member to the second conveying means.

6. The image forming apparatus according to claim 5, wherein the second conveying means includes:

an endless conveyor belt; and a conductive guide member arranged in the inside of the conveyor belt in contact with the conveyor belt and the bias voltage is applied thereto by the applying means.

7. An image forming apparatus comprising:

image forming means for forming a developer image on an image carrier;

conveying means for conveying an image receiving member toward the image carrier;

transfer means for supplying a transfer charge to the image receiving member conveyed by the conveying means and transferring the developer image formed on the image carrier to the image receiving member;

a guide member for guiding the image receiving member conveyed by the conveying means toward the transfer means;

separation means, arranged at the downstream side of the transfer means along the transfer direction of the image receiving member, for separating the image receiving member having the developer image transferred by the transfer means from the image carrier;

applying means for applying a bias voltage of the same polarity as the transfer charge to the guide member; and control means for controlling the applying means so as to apply the bias voltage to the guide member at the time the image receiving member reaches the separation means when transferring the developer image onto the image receiving member by the transfer means.

8. The image forming apparatus according to claim 7, wherein the image forming means includes:

charging means for charging the surface of the image carrier to a specified potential by giving an electric charge thereto;

exposure means for exposing the surface of the image carrier charged by the charging means according to an image signal to form an electrostatic latent image; and developing means for forming the developer image by supplying a charged developer to the electrostatic latent image formed on the surface of the image carrier.

9. The image forming apparatus according to claim 7, wherein the guide member is made of a conductive member.

10. The image forming apparatus according to claim 7, wherein the image carrier includes a photosensitive drum arranged rotatable centering around a rotary shaft;

the transfer means includes a transfer charger arranged opposing to the surface of the photosensitive drum and having a first charge wire extending nearly in parallel with the rotary shaft of the photosensitive drum to transfer the developer image from the photosensitive drum onto the image receiving member by giving the corona discharge from the first charge wire to the image receiving member;

the separation means includes a separation charger having a second charge wire extending nearly in parallel with the rotary shaft of the photosensitive drum to separate the image receiving member from the drum surface by giving the corona discharge from the second charge wire; and the control means controls the applying means to apply the bias voltage to the guide member when a leading edge of the image receiving member reaches a separation point where the straight line connecting the second charge wire of the separation charger and the rotary shaft crosses the drum surface.

11. The image forming apparatus according to claim 7 further comprising:

second conveying means for conveying the image receiving member passed the separation means further to the downstream; and the applying means also applies the same bias voltage as the bias voltage applied to the guide member to the second conveying means.

12. The image forming apparatus according to claim 11, wherein the second conveying means includes:

an endless conveyor belt; and a conductive guide member arranged in the inside of the conveyor belt in contact with the conveyor belt and the bias voltage is applied thereto by the applying means.

13. An image forming apparatus comprising:

a photosensitive drum including a drum surface, which is adapted to have a developer image formed thereon;

a conveyor that conveys an image receiving member toward the drum surface;

a transfer charger that supplies a transfer charge to the image receiving member and transfers the developer image to the image receiving member;

a guide member provided between the conveyor and the transfer charger that guides the image receiving member from the conveyor to the transfer charger;

a separation charger downstream from the transfer charger that supplies a separation charge to the image receiving member to separate the image receiving member from the drum surface;

a guide bias voltage source that applies to the guide member a bias voltage having the same polarity as the transfer charger; and a controller that controls the guide bias voltage source such that the guide bias voltage source applies a first bias voltage to the guide member when a part of the image receiving member receives only the transfer charge and a remaining part of the image receiving member is on the guide member, and such that the guide bias voltage source applies a second bias voltage, which is larger than the first bias voltage, when a part of the imager receiving member receives both the transfer charge and the separation charge and a remaining part of the image receiving member is on the guide member.

* * * * *